US005755086A

United States Patent [19]

Halbheer et al.

[11] Patent Number: 5,755,086

[45] Date of Patent: May 26, 1998

[54] ARRANGEMENT OF DRAW TEXTURING MACHINES FOR SYNTHETIC FIBERS

[75] Inventors: Rudolf Halbheer, Bülach; Werner Flachmüller, Richenbach, both of Switzerland

[73] Assignee: Maschinenfabrik Rieter AG, Winterthur, Switzerland

[21] Appl. No.: 562,600

[22] Filed: Nov. 24, 1995

[30] Foreign Application Priority Data

Nov. 25, 1994 [CH] Switzerland ..... 03562/94

[51] Int. Cl.[6] ..... D01H 13/26; D02G 3/02

[52] U.S. Cl. ..... 57/351; 28/247; 57/1 R; 57/290; 57/328

[58] Field of Search ..... 57/1 R, 328, 351, 57/290, 287, 288; 28/219, 220, 240, 247

[56] References Cited

U.S. PATENT DOCUMENTS

| | | | |
|---|---|---|---|
| 2,780,347 | 2/1957 | Givens | 28/219 |
| 3,337,930 | 8/1967 | Aelion et al. | 28/1 |
| 3,474,612 | 10/1969 | Jenkins et al. | 57/287 |
| 3,724,191 | 4/1973 | Hooper et al. | 57/290 |
| 3,938,397 | 2/1976 | Hooper | 57/287 |
| 3,942,312 | 3/1976 | Venot | 57/290 |
| 3,995,420 | 12/1976 | Ohse et al. | 57/288 |
| 4,343,146 | 8/1982 | Nelson | 28/220 |
| 4,825,517 | 5/1989 | Hagler | 28/220 |

FOREIGN PATENT DOCUMENTS

| | | | |
|---|---|---|---|
| 0 310 890 | 4/1989 | European Pat. Off. . | |
| 1432105 | 10/1988 | U.S.S.R. | 28/219 |
| 2133810 | 8/1984 | United Kingdom | 57/288 |

*Primary Examiner*—William Stryjewski
*Attorney, Agent, or Firm*—Burns, Doane, Swecker & Mathis, LLP

[57] ABSTRACT

A machine unit through which a thread is guided includes a drafting unit comprised of double godets, a texturing unit, a relax unit comprising double rollers, and a winding device. The drafting unit and the relax unit are arranged at an angle of less than 90° to a reference plane, while the winding device is arranged at an angle (δ) of essentially 90° to the reference plane. Furthermore, an operator's working position is provided, from which the aforementioned arrangement of the drafting unit and relax unit relative to the winding device is accessible.

3 Claims, 1 Drawing Sheet

ARRANGEMENT OF DRAW TEXTURING MACHINES FOR SYNTHETIC FIBERS

FIELD OF THE INVENTION

The invention relates to an arrangement of draw-texturing machines for synthetic fibers, and more particularly to an arrangement of draw texturing machines that includes a drafting unit, a texturing unit, a relax unit and a winding unit.

BACKGOUND OF THE INVENTION

The processing of fibers such as synthetic fibers typically involves the use of various units such as a drafting unit, a texturing unit, a relax unit and a winding unit. As is known, such units are all provided in a parallel vertical arrangement, with the drafting unit, the texturing unit and the relax unit being located above the winding unit.

With the increasing yarn running speed up to 6000 meters/minute in the winding unit and the need to process and wind a multiplicity of threads simultaneously, the dimensions of the godets or rollers used in the drafting, texturing and relaxing units, have increased so much in diameter as well as length, that the threading of all these units is not without problems for the operating personnel. Further, the high thread running speed and the high temperatures of the godets present problems when such threading procedures are carried out manually since the threads must be guided through the suction jets by hand.

Difficult servicing leads in addition to faulty manipulations and potentially increased wastage during threading procedures of a product which is dear in itself, and also presents a certain amount of danger for the operating personnel.

SUMMARY OF THE INVENTION

For this reason, the task has been set of finding an arrangement of the individual units which addresses the foregoing concerns and facilitates machine operation.

The present invention provides a machine unit in which a drafting unit, a texturing unit and a relax unit are disposed above the winding unit and are arranged next to each other at least partially staggered and parallel to each other in a generally horizontal arrangement. The center line of at least one of the rollers of the drafting unit, the texturing unit and the relax unit each define an angle with respect to a reference plane which is larger than 0° and smaller than 90°, while the winding device defines an angle of 90° with respect to the reference plane. The winding units are arranged substantially in a row essentially parallel to each other.

It is advantageous when providing a plurality of machine units which each include a drafting unit, a texturing unit, a relax unit and a winder unit, to arrange the machine units as an entirety next to each other in a row. A further advantageous embodiment exists in that a generally centrally located, higher working position for the operator is provided, from which position all the details of the separate units of the machine unit can be serviced in detail when guiding the thread.

Advantages of the present invention lie in the fact that comfortable servicing is possible when "guiding" the thread through the aforementioned units during the running of the thread. Also, the entire course of the thread can be guided from a single position, through which there is a shorter guiding time for the threading. Further, because of the improved accessibility, fewer false threading manipulations occur and so less total wastage results.

BRIEF DESCRIPTION OF THE DRAWING FIGURES

Additional features and details of the invention will become more apparent from the detailed description of the invention set forth below considered in connection with the accompanying drawing figures in which like elements are designated by like reference numerals and wherein:

FIG. 1 is a front view of an arrangement of draw-texturing machines according to the invention, represented schematically in part; and FIG. 2 is a top view of the arrangement shown in FIG. 1.

DETAILED DESCRIPTION OF THE INVENTION

Figure 1:
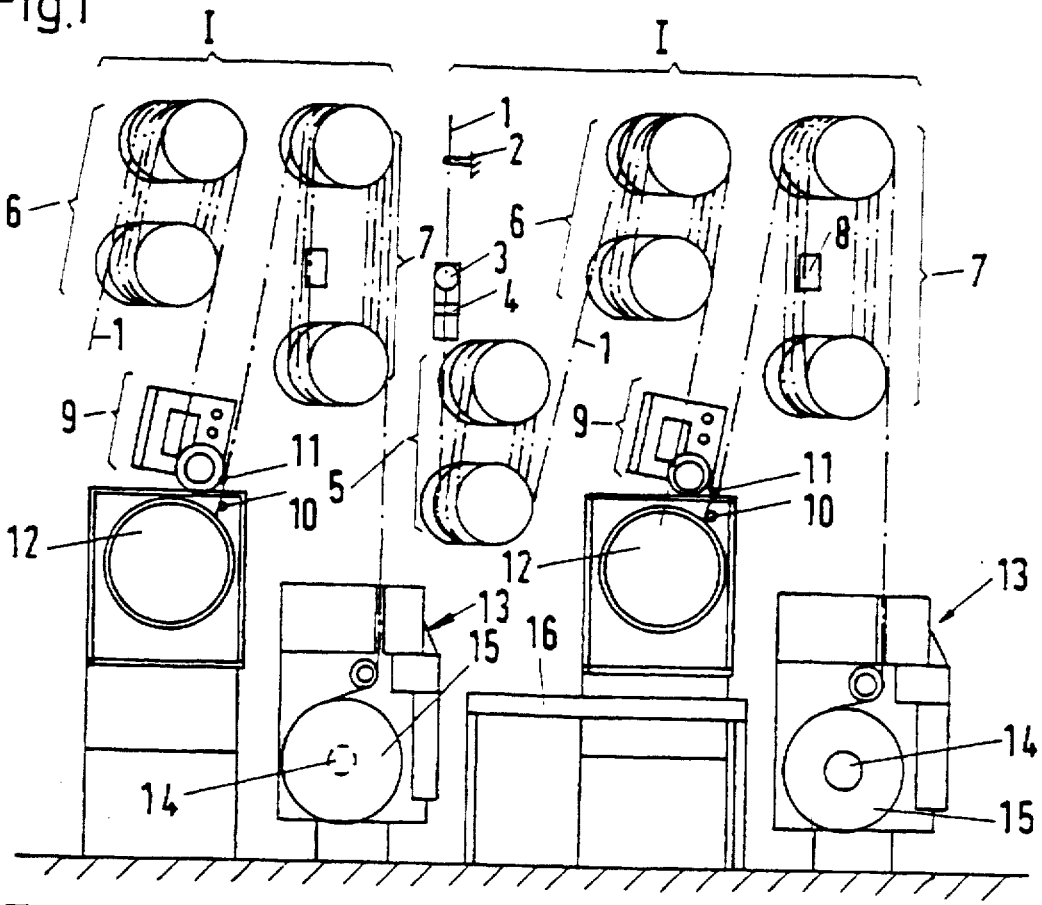

FIG. 1 shows a thread 1 originating from any prearranged unit, not represented, for example, a spinning tube, which in the course of the thread is guided primarily through an eyelet 2 before being guided through a suction device 3 and then through a separating knife 4. The thread is then guided with a predetermined number of windings over a pair of godets 5 and, after this, is guided with a predetermined number of windings over a pair of godets 6. The two pairs of godets 5, 6 together form a drafting unit.

After the pair of godets 6, the thread 1 is guided through a texturing unit 9, which can fundamentally be any known texturing unit, but in this case, however, is a so called "Rolltex"—texturing unit, which is shown and described in published European specification No. 0310890 A1. After the texturing unit 9, the texturing grafts, which are well known, arrive at a cooling drum 12 on which the filament, warmed and compressed in the texturing unit 9 to the aforementioned texturing grafts, is cooled.

After the cooling drum 12, the texturing graft is again released. That is, the thread is guided over the guide rollers 10, 11 which function as brakes, so that the grafts in the area between the guide rollers 11, 10 as well as before the following pair of godets 7, are again drafted to a thread in which the texturing, although in a stretched form here, has remained.

The pair of godets 7 form a relax unit, by means of which the textured threads are again warmed in a known way, in order to retain a texturing intensity of the predetermined kind.

Between the godets of the pair of godets 7, there is an intermingling jet 8 provided for the course of the thread, which, preferably after half of all the windings guided over the pair of godets 7, intermingles the textured thread in the known way. This intermingling jet can be, for example, an intermingling jet such as that which is sold under the trade name TEMCO.

After the relax unit 7, the textured and intermingled threads at the end of the course of the thread are guided into a winding device 13, in order to be wound on a winding mandrel 14 into a bobbin 15. The invention is not restricted to the use of the winding device shown. Rather, any winding device can be used.

Figure 2:
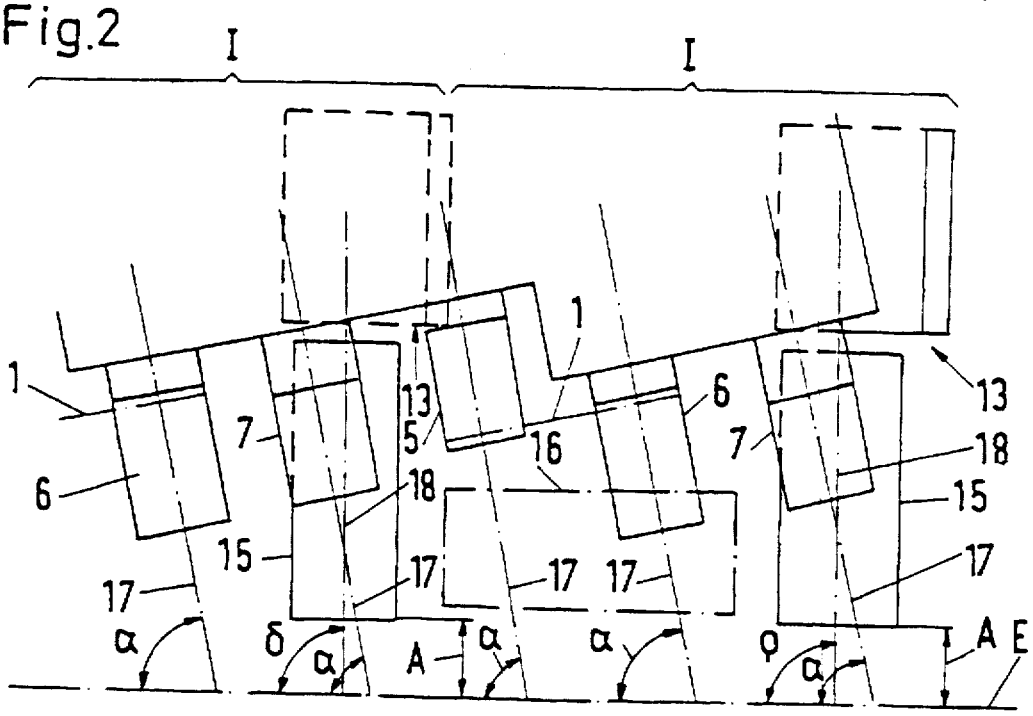

According to the height of the arranged pairs of godets 5, 6, 7, a working position 16 (represented by dotted lines in FIG. 2) is provided which permits the operator, in the aforenamed threading process, to carry out the threading of the staggered arrangement of the rollers shown in plan view in FIG. 2. The working position 16 in the illustrated form is a stand which is elevated off the ground and on which the operator can stand.

FIG. 2 illustrates how the godets 5, 6, 7 forming the drafting unit and the relax unit are arranged relative to one another and to the working position 16. As seen with reference to FIG. 2, the center line 17 of one of the godets of each pair of godets 5, 6, 7 define an angle alpha ($\alpha$) greater than 0° and smaller than 90°, preferably between 60° and 80°, with respect to a reference plane E. The reference plane E is a vertical plane positioned in spaced apart relation to the front portion of the bobbin 15. For the sake of simplicity, only the upper godet of each pair of godets is illustrated in FIG. 2. Also, in the illustrated arrangement, the longitudinal axis 17 of the upper godet of each pair of godets forms the angle $\alpha$ with respect to the reference plane E. FIG. 2 also depicts the positioning and orientation of the winding unit 13 and specifically illustrates the center line 18 of the winding mandrel 14 or of the bobbin 15 defining an angle $\delta$ with respect to the reference plane E. This angle $\delta$ is equal to or substantially equal to 90°.

As seen in FIG. 1, the draw unit, the texturing unit, the relax unit and the winding device 13 which together define a machine unit I are arranged next to each other in a partially staggered generally horizontal arrangement or row. As depicted in FIG. 2, the winding units 13 of adjacent machine units I are spaced from the imaginary reference plane E by a similar distance A.

The drafting unit and the relax unit are arranged in a way that facilitates access by an individual at the working position 16. In this regard, FIG. 2 illustrates that the longitudinal axis or center line of one of the godets of each of the drafting unit, the texturing unit 9 and the relax unit 7 are oriented at generally the same angle $\alpha$ with respect to the reference plane E. Further, from a plan view, the longitudinal axis or center line 17 of one of the godets of the pair of godets 5 and the longitudinal axis or center line 17 of one of the godets of the pair of godets 6 pass through the working position 16 as clearly seen in FIG. 2. From a three-dimensional standpoint, it can be said that the longitudinal axis or center line 17 of one of the godets of the godet pair 5 intersects a parallelepiped defined by an imaginary upward extension of the outer boundaries of the stand 16. Likewise, it can be said that the longitudinal axis or center line 17 of one of the godets of the godet pair 6 also intersects such a parallelepiped.

The horizontal arrangement of the godet pairs 5, 6, 7 is clearly shown in FIG. 2 where it can be seen that the longitudinal axis 17 of one of the godets of each pair is horizontally spaced from the longitudinal axis 17 of the one godet of the adjacent godet pair.

As a result of the foregoing arrangement, an operator standing on the stand 16, which can possess a length of about one meter in the direction parallel to the reference plane E and a width approximately one-half the length, can easily reach all of the units forming the machine unit, thus greatly improving the ease with which the units can be serviced. As can be seen, the drafting unit 5, 6, the texturing unit 9 and the relax unit 7, are arranged so that the threads 1 extending from the godets 5 of the drafting unit to the godets 7 of the relax unit 7 traverse a space located directly above the working stand 16.

Preferably, the relax unit 7 is positioned vertically above the winding unit so that the textured and intermingled threads from the relax unit are able to extend substantially straight downwardly to the winding unit 13 without significant deviation. In addition, although the foregoing description in conjunction with the illustration in FIG. 2 refers to the longitudinal axis 17 of the upper godet of the respective godet pair, it is to be understood that the longitudinal axis 17 could also be the longitudinal axis of the lower godet of each respective godet pair. Also, the longitudinal axis 17 could refer to what would constitute a median longitudinal axis defined by the median of the longitudinal axes of the godets forming each godet pair.

The principles, preferred embodiments and modes of operation and the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. Arrangement of draw-texturing machine units for processing synthetic filaments threadable by an operator, each machine unit comprising a drafting unit, a texturing unit downstream from said drafting unit, a relax unit downstream from said texturing unit, and a winding unit downstream from said relax unit; said drafting unit including a first pair of godets rotatable on substantially horizontal axes spaced vertically one above the other and a substantially parallel second pair of godets rotatable on substantially horizontal axes spaced vertically one above the other; said relax unit including a substantially parallel third pair of godets rotatable on substantially horizontal axes spaced vertically one above the other, a center line of the drafting unit and the relax unit each defining an angle with respect to a reference plane which is greater than 0° and smaller than 90°, and a center line of the winding unit defining an angle of substantially 90° with respect to the reference plane, the winding units of each machine being arranged in a row substantially parallel to each other and with a predetermined clearance with respect to the reference plane.

2. Arrangement according to claim 1, wherein a center line of the drafting unit and a center line of the relax unit each defines with respect to said reference plane an angle between 60° and 80°.

3. Arrangement according to claim 2, including a central working position for the operator for each machine unit, from which the entire filament path is accessible; the longitudinal axis of at least one of the godets of said first pair and the longitudinal axis of at least one of the godets of said second pair passing through said working position.

* * * * *